US006821196B2

(12) United States Patent
Oliver

(10) Patent No.: US 6,821,196 B2
(45) Date of Patent: Nov. 23, 2004

(54) PYRAMIDAL MOLDED TOOTH STRUCTURE

(75) Inventor: Lloyd R. Oliver, Algonac, MI (US)

(73) Assignee: L.R. Oliver & Co., Inc., Fair Haven, MI (US)

( * ) Notice: Subject to any disclaimer, the term of this patent is extended or adjusted under 35 U.S.C. 154(b) by 0 days.

(21) Appl. No.: 10/348,113

(22) Filed: Jan. 21, 2003

(65) Prior Publication Data

US 2004/0139957 A1 Jul. 22, 2004

(51) Int. Cl.[7] ..... B23F 21/03
(52) U.S. Cl. ..... 451/546; 451/544
(58) Field of Search ..... 451/540, 544, 451/546, 547, 541; 125/22; 407/29.1, 29.11, 29.12, 29.13, 29.14, 29.15

(56) References Cited

U.S. PATENT DOCUMENTS 3,963,458 A * 6/1976 Gladstone et al. ..... 51/295
4,028,852 A * 6/1977 Harrington et al. ..... 451/541
4,916,869 A 4/1990 Oliver
4,925,457 A * 5/1990 deKok et al. ..... 51/293
5,453,041 A * 9/1995 Oliver ..... 451/541
5,560,745 A * 10/1996 Roberts ..... 451/540
RE35,812 E 6/1998 Oliver
2002/0197947 A1 * 12/2002 Sagawa ..... 451/540

* cited by examiner

*Primary Examiner*—Dung Van Nguyen
(74) *Attorney, Agent, or Firm*—Dinnin & Dunn, P.C.

(57) ABSTRACT

A molded tooth design of generally pyramidal form made of various hard grit materials for use on a grinding wheel for grinding non-metal materials. The tooth structure generally includes a raked face having a neutral to positive rake angle that terminates to a sharp point. The tooth structure also includes on the raked face edge portions below the point extending from both sides thereof having a predetermined clearance angle to increase penetration and reduce friction of the tooth during the grinding process. The tooth structure may also include at a top end of the rake face a truncated clearance surface which will produce a wider cutting edge that is flat, for use in attacking the work surface of the work piece being ground. The rake face of the tooth generally may also be formed to have positive rake in the truncated surface.

20 Claims, 2 Drawing Sheets

PYRAMIDAL MOLDED TOOTH STRUCTURE

BACKGROUND OF THE INVENTION

1. Field of the Invention

The present invention generally relates to abrasive grit structures used in the grinding and shaping of various materials, and in particular relates to a molded pyramidal tooth structure for use in the cutting and grinding of non metal materials and compositions.

2. Description of Related Art

Abrasive grit tool structures have been known for numerous years. Generally, the abrasive grit tool structures include devices such as grinding wheels, hand tools and the like which generally have an outer grit particle surface which is used to remove portions of a work piece for shaping and finishing a work piece. In many prior art structures abrasive grits have been attached to tool surfaces by placing a single layer of grit particles on a tool form and then binding the grits to the tool by using a brazing metal or by an electro plating coating which grips the grit particles. These structures along with other types of structures have the disadvantage in that the resulting tool may have grits of widely varying heights, erratic grit edges, flat spots or other irregular surfaces which tend to present an uneven grinding surface with relation to the work piece. It has to be noted that in grinding structures the desired effect is to present the abrasive grits to the work piece at a uniform level in order to most effectively shape the work piece. Many of these prior art grinding wheels and the like fail to meet this objective.

As stated above these grinding wheel prior art devices are generally made from electroplating or brazing of materials on to the outer surface of these structures. It should be noted that other grinding wheel structures have been produced by either pressure forming a grinding wheel on a mold or grinding surfaces have been added to tools by placing an individual tool on the mold and using pressure molding and brazing procedures to attach the grinding surface to a substrate mold surface. However, many of these prior art procedures are costly, time consuming and require special equipment that is hard to manufacture and maintain.

Furthermore, many of the prior art grinding wheel structures generally do not provide adequate space between the grinding particles. This would result in diminished use for the life time of the tool due to particles of the work piece being lodged between the grit particles or extending over the grit particles such that contact between the individual grit particles and the work piece is reduced thereby inhibiting the grinding action and efficiency of the wheel.

It should also be noted that many prior art attempts have been made to use diamond particles as the grinding grit particle in prior art grinding wheels. However, many of these prior art grinding wheels have developed problems in that the diamonds are difficult to hold or bond to a surface in a manner that will not break off during the grinding process. Therefore, generally the prior art grinding wheels using diamond grits initially worked well but after a period of use the diamond grit particles would eventually break away from the sub-straight structure thus reducing the effectiveness of the tool and reducing the tools long term grinding life.

Therefore, there is a need in the art for an improved grinding wheel that includes a plurality of teeth arranged in a predetermined pattern that is capable of grinding non-metallic materials in a cost effective long-tern package. There also is a need of a grinding wheel that will perform more efficiently and reduce the amount of friction encountered during the grinding on the non-metal materials. Furthermore, there is a need in the art for a grinding wheel that has a tooth structure that does not have a negative rake angle of attack when the grinding wheel encounters the substance being worked.

SUMMARY OF THE INVENTION

One object of the present invention is to provide an improved grinding wheel for use in grinding non-metal materials.

Another object of the present invention is to provide an improved tooth design to be molded of various hard grit materials.

Yet a further object of the present invention is to provide a grinding tool having a plurality of pyramidal teeth that are orientated in a working direction to have a zero to positive rake angle.

Still a further object of the present invention is to provide a grinding wheel with a plurality of teeth that have increased cutting clearance on both side edges emanating from a point of each tooth.

Still another object of the present invention is to provide a grinding wheel having a plurality of teeth with edges that will perform in a more efficient manner.

Still another object of the present invention is to provide a grinding wheel that will operate with less friction while also increasing the durability of the grinding wheel.

Still another object of the present invention is to provide a grinding tool for use in grinding non-metal materials at a lower cost with reduced maintenance.

To achieve the foregoing objects, a molded tooth structure for use on a tool surface for the cutting or grinding of non-metal materials is disclosed. The molded tooth structure includes a plurality of pyramidal like shaped body portions. Each of the body portions having a flat rake face. Each of the body portions having at least one grit particle therein and each body terminating to a point or width of edge. The points being substantially equal in height. The grit particles of the body portions being substantially surrounded by a setting material. The molded tooth structure also including a bonding agent disbursed throughout the structure for temporarily bonding the grit particles and the setting material.

One advantage of the present invention is that it provides an improved pyramidal tooth structure for a grinding tool.

Still another advantage of the present invention is that it provides an improved grinding wheel for use in grinding non-metal materials.

Still another advantage of the present invention is that the pyramidal teeth structure provides a more efficient grinding wheel.

Still another advantage of the present invention is the pyramidal tooth structure provides less friction caused heat during the grinding of non-metal materials.

Still another advantage of the present invention is that the tooth structures include a neutral to positive rake angle as an initial cutting surface for the grinding wheel.

Still another advantage of the present invention is the use of increased cutting clearance on both sides edges of each individual tooth on the grinding wheel.

Yet a further advantage of the present invention is that the top piercing point or edge width of each tooth increases the cutting surface of the grinding wheel.

Still another advantage of the present invention is the low cost to build and maintain the grinding wheel using pyramidal teeth according to the present invention.

Other objects, features and advantages of the present invention will become apparent from the subsequent description and the appended claims, taken in conjunction with the accompanying drawings.

BRIEF DESCRIPTION OF THE DRAWINGS

FIG. 6 shows a side view of an alternate embodiment of a tooth structure according to the present invention.

DESCRIPTION OF THE EMBODIMENT(S)

Figure 1:
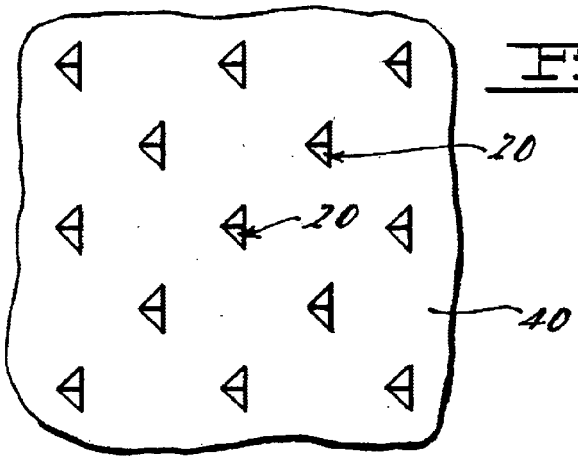
FIG. 1 shows a fragmentary plan view of a portion of a molding surface using the pyramidal molded teeth according to the present invention.

Referring to the drawings, the present invention of improved pyramidal molded teeth 20 for mating with a grinding wheel 22 are shown. It should be noted that the pyramidal molded teeth 20 will use an abrasive grit structure that is selectively attachable to a tool surface or a tool such as a grinding wheel 22 or the like. Applicant has developed various methods and apparatuses for connecting or molding teeth like structures to tool or surfaces and the present invention can be used with any of the applicant's previous inventions and therefore, the applicant hereby incorporates by reference prior U.S. Pat. Nos. Re. 35,812 and 4,916,869.

The pyramidal molded teeth structure 24 comprises a plurality of pyramidal shaped teeth 20. Each of the teeth 20 includes a body portion 26. The teeth 20 are substantially the same height such that the teeth 20 are coplanar. At least one abrasive grit 28 particle is provided within the body portion 26 of the teeth 20. In one embodiment it is preferable to have at least one grit particle 28 provided near or at the apex of each tooth 20. In other contemplated embodiments a plurality of grit particles 28 are randomly placed throughout the tooth 20. The abrasive grit particles 28 are substantially surrounded by a particle setting matrix 30. The particle setting matrix, 30 may include a setting material 32 that substantially surrounds the grit particles 28 in and around the apex and may even include a second particulate matter 34 substantially filling the remainder of the body portion 26. The particulate matter 34 has a melting point temperature which is higher than a predetermined value and in the preferred embodiment of the present invention the melting point is higher than the melting point of a brazing alloy used to bond the constituents together.

A flexible binder 36 is disbursed throughout the tooth structure 20. It should be noted that in one embodiment the flexible binder 36 is a hydrocarbon resin but that any other flexible binder known may be used. The resin binder 36 is for temporarily binding together the abrasive grit particles 28, the setting material 32, and the particular matter 34 and for retaining these constituents in there respective positions for later positioning onto a tool structure. The binder 36 is volatile such that it may be driven or removed from the structure at a first relatively low predetermined temperature. The tooth structure 20 is brazable to a tool surface 38 by in infiltration of a brazing material therethrough and onto the tool surface 38 at a second higher predetermined temperature which is lower than the melting point of the particulate material 34.

The abrasive grit particles 28 used in the present invention may be of any kind of metal carbide, boride grits or grits which are harder then metal carbides and up to and including diamond-like hardness. For instance, various cast or sintered metal carbide grits may be suitably used in the present invention while it should also be noted harder grits such as cubic boron nitrite, polycrystalline diamond or natural diamond grits can be used also in the present invention. However, in one embodiment a diamond grit particle may be used. The setting material 32 consists of a material which will provide adequate strength for holding the particle 28 in the structure such as by in chemically bonding with the brazing material. In one embodiment of the invention where a diamond or like hard particle is used the setting material is a fine metal carbide powder. The design of the tooth form is such that it is molded of various particle sizes by a molding means that is used to form the non-melting particles to a predetermined size and shape while also allowing the molded teeth 20 to be removed and transferred to a premachined metal body 22 for use as tooth armoring on a grinding wheel 22. These preformed teeth 20 are subsequently infiltrated and brazed to the body of the grinding wheel 22 by use of a filler metal which has a lower melting temperature than the particles molded in the tooth form 20 and the tool body 38 to be armored.

The setting material used in one embodiment of the invention is selected so that it may be easily wetted by a brazing compound used in the final brazing of the structure of the present invention. Suitable setting materials are commercially available and are known to those skilled in the art.

If used, the particulate matter may be of the same material as used in the setting powder such as the metal carbide grit particle material but which particles are larger in size then the powder particles. Alternatively, it is contemplated that the particulate material used for layers may be the same in size and composition and may have a particle size of from about 100 mesh to approximately micron size particles. Preferably, a tungsten carbide particle material is used. Particles of crushed cast or sintered tungsten metal group carbides, chromium carbides, chromium borides or mixture thereof which may also include diamond particles may also be used. The size of the particles used in the particulate matter can be anywhere from a 325 mesh or larger particle. The particulate matter used for the present invention is selected with two over riding factors. The first is that the material is wettable with the type of brazing material to be used while the second is that the particles must also be substantially non-melting up to and past the temperature for melting of the brazing material.

These particles which form the primary constituents of the setting powder and particulate matter generally are non-melting constituents of the present invention. It is preferable that particles generally will not melt up to temperatures of approximately 2150° Fahrenheit which is at or above the melting temperature of the preferred nickel chromium alloy used in the present invention. A metal carbide such as a tungsten carbide particle is preferred in that the nickel chromium alloy will form a chromium carbide bond to these metallic particulate structures which will strengthen and provide a durable substrate structure and matrix for securely holding the diamond particle in the subsequent tooth structure 20. However, all the brazing compounds which contain metals for forming metal carbide bonds with diamonds or like hardness grit particles may be used in the present invention.

In particular tungsten group metal carbide particles are particularly suitable as their coefficient of expansion is more near that of a diamond or diamond like hardness material. This allows a tungsten carbide particulate material to act as a buffer between the steel tool surface and the diamond particle. The use of this tungsten carbide particulate material advantageously acts to prevent the chemical bond breaking of the chromium carbide bond of conventionally brazed structures. Therefore, a final brazed structure having superior bond strength is formed in the present invention. It should be noted that an alternate contemplated embodiment of the present invention cubic boron nitride particles, which do not contain carbon, may also be used. While such particles may not form chemical bonds with brazing components to be used, these particles will be used to form the grit particles and will provide a close mechanical bond in the subsequent product. Particulate matter may be used to fill the mold indentations to form peaks by filling the same up to and even with the base of the teeth 20. Alternatively, the mold may be filled above the body 26 to create a substrate layer. If the tooth structure 20 apexes are filled to the base, the tooth structure 20 may be applied to the tool surface 38 directly from the mold by placing a binder adhesive layer on the tool surface 38 and applying the mold containing the teeth 20 of the grit structure thereon and then removing the mold leaving a tool surface 38 with the abrasive grit teeth 20 adhered thereto. Alternatively, the teeth structures 20 may be individually separated and individually applied to a tool surface 38. These teeth 20 may then be brazed into a tool as set forth below. The substrate provides a backing material such that the grit structure may be removed from the mold surface as a sheet and then applied to the tool structure at a later period of time, or alternatively, the grit structure may be removed and the teeth 20 broken apart to allow individual attachment to a tool surface 38.

The binder which is provided to temporarily bond a particle, the powder matrix and the particulate matter in the structure of the present invention may be a hydrocarbon binder or other similar type. The subsequent cured product is preferably flexible to facilitate application to various shaped tool substrates at a later time and therefore, a flexible type binder is preferred for use in the present invention. However, if the final product is to be a brazed homogeneous structure rather than brazed onto a tool for armoring of the tool or if the tooth structures are to be individually separated or broken apart it is preferable to use a binder that cures to a stiff type consistency. Acrylic type binders are generally preferred however any suitable solvent soluble hydrocarbon material may be used.

To use the tooth structures 20 provided in the present invention a molding surface is provided to create a mold for the pyramidal shape tooth structures 20 in which the structure is created. The mold preferably has a surface having shaped indentations therein for producing the grit tooth structure 20 of the present invention. The mold may be configured in any form that is advantageous to form a grit tooth structure 20 as long as the indentations are substantially the same height so they are presented in the mold surface along substantially a similar plane.

Therefore, in one embodiment of the present invention the mold is in the form of a rectangular planar structure 40 such that rectangular sheets of a grinding toothed structure 34 are produced as shown in FIG. 1. The indentations are preferably formed in a pyramidal tooth like shape in one embodiment which produces a "green" product when bound with the acrylic binder having a series of pyramidal shaped teeth 20. The mold is preferably produced from mating a suitably machined male surface using a suitable elastomeric compound such as silicone, rubber material or the like.

Figure 2:
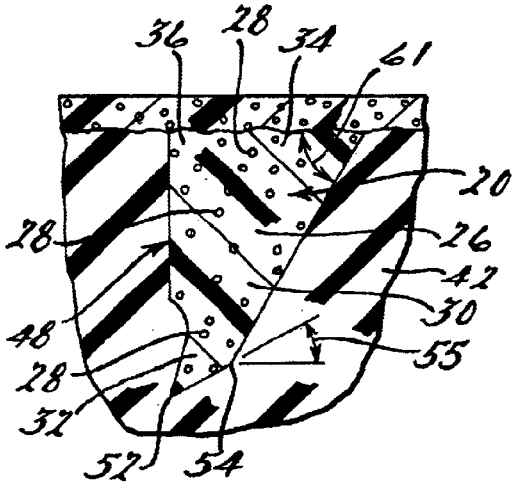
FIG. 2 is a cross section view of a portion of the mold surface of FIG. 1 showing a pyramidal tooth according to the present invention taken along a lateral section of a represented peak.

FIGS. 2 through 5 show one embodiment of the present invention having the pyramid tooth structure 20. FIG. 2 shows the female mold 42 which is generally made from the male mold as described above. The female mold 42 is subsequently filled with the desired hard and wear resistant grit materials as described above. After filling the molds 42 a subsequent green state binder is used to enable the production of flexible sheets of the molded pyramidal teeth 20 for transferring to a steel base member tool 22. Subsequently or prior to removal from the molds the teeth 20 have a suitable stainless brazing metal applied thereto. The armored tool is then fused in a controlled atmosphere furnace to braze the tooth constituents together and to connect the tooth constituents to the steel tool form 22.

FIG. 2 shows a side view of a tooth 20 according to the present invention. The tooth 20 generally has a pyramidal shape. In the embodiment shown the shape is actually one half of a pyramid shaped tooth 20. The tooth structure 20 includes a first 44 and second pyramidal side 46. The tooth structure 20 also includes a rake face 48 generally having a flat surface. Therefore, the rake face or attacking face 48 of each tooth structure 20 will appear as a flat surface to the work piece being ground. As shown in FIG. 2 the rake face 48 will generally be defined as having a neutral/0° up to any positive rake angle. As shown in FIG. 2 a positive rake angle of approximately 15° is shown. However, it should be noted that any rake angle from neutral/0° all the way up to 90° may be used for the present invention. The rake face defines the cutting width presented to the work piece being ground by the toothed grinding wheel 22.

Figure 3:
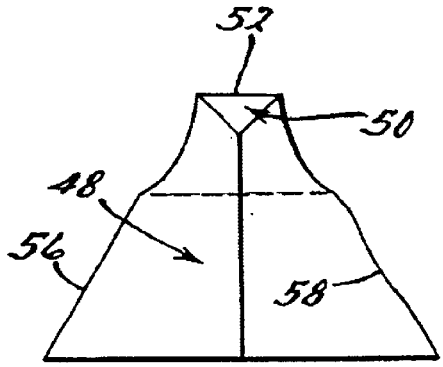
FIG. 3 shows a rear view of a tooth structure according to the present invention.
Figure 4:
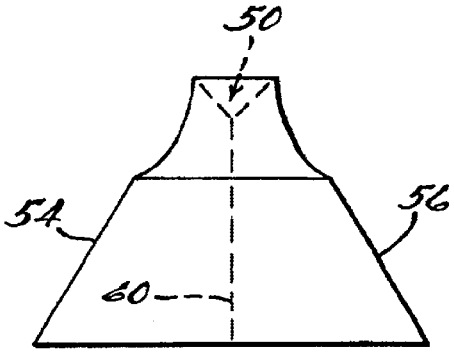
FIG. 4 shows a front view of a tooth structure according to the present invention.
Figure 5:
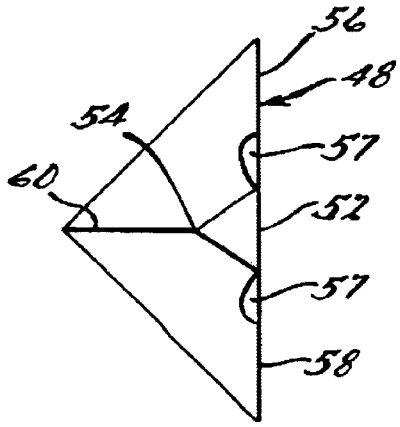
FIG. 5 shows a top view of a tooth structure according to the present invention.
Figure 7:
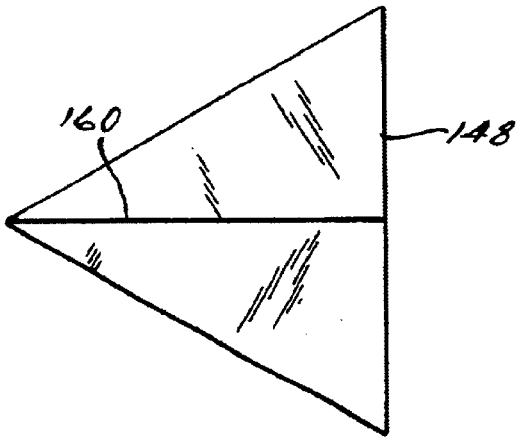
FIG. 7 shows a top view of an alternate embodiment of a tooth structure according to the present invention.
Figure 8:
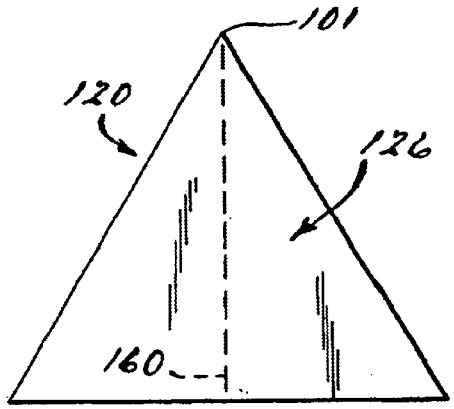
FIG. 8 shows a front view of an alternate embodiment of a tooth structure according to the present invention.
Figure 9:
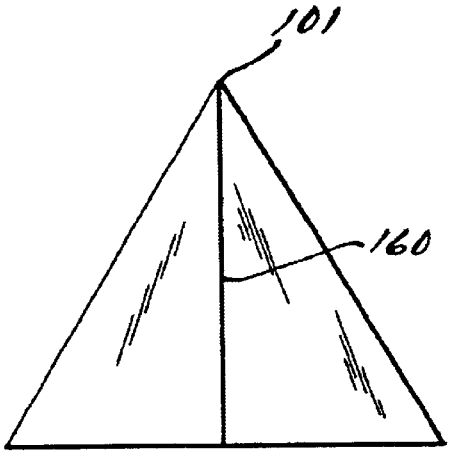
FIG. 9 shows a rear view of an alternate embodiment of a tooth structure according to the present invention.
Figure 8:
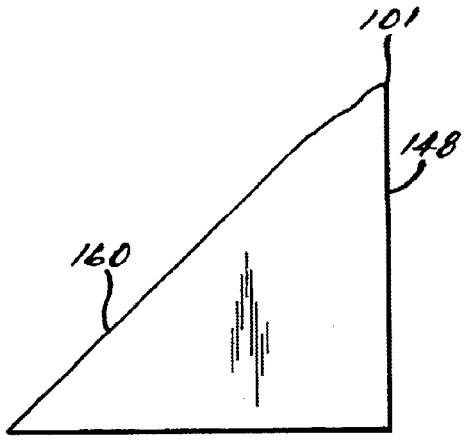
Figure 10:
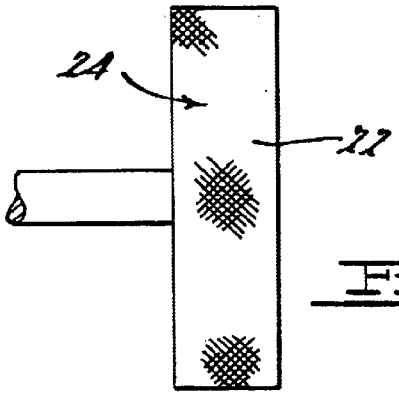
FIG. 10 shows a plan view of grinding wheel for use with the teeth according to the present invention.

As shown in FIGS. 2 through 5 the tooth structure 20 has a truncated top portion 50 which will increase the width of the flat cutting edge 52 being presented on the rake face 48 of the pyramidal tooth structure 20. The tooth 20 also includes a clearance angle 55 from the flat edge 52 of the cutting rake face 48 to the trailing edge 54 of the pyramidal shape tooth 20. The clearance angle may be 10° or more, as shown in figure 2 the clearance angle between the cutting edge 52 of the rake face 48 and the trailing edge 54 is approximately a 30° angle. The tooth 20 has a predetermined included angle of the side edges 56, 58, defining the rake face 48. This included angle may in any embodiment exceed 15°. The rake face 48 two side edges 56, 58 also have a predetermined clearance angle 57 extending from both side edges 56, 58. This will allow for increased penetration and reduced friction of the tooth structure 20 into the material being ground on the work piece. As shown in figure 5 a clearance angle may be incorporated into each side edge 56, 58 of the rake face 48 to further increase penetration and reduce friction between the tooth structures 20 and the material being ground. As shown in FIG. 3 the first and second side edges 56, 58 of the rake face each having a plane that extends therefrom and meet at the rear edge 60 which will buttress the rake face 48 and improve the cutting efficiency of the tooth structure 20. Therefore, it should be noted that any positive rake angle may be used for the rake face or a neutral/0° angle may be used. The rake angle being defined as the angle made by the edge of the cutting tool or tooth structure and a plane perpendicular to the surface that is being worked.

The tooth 20 as shown in FIG. 5 may have an included angle 61 selected as desired in a range between 5° and 90°. In the embodiment shown a 60° included angle is shown. This included angle may be the same as the included angle of the rake face side edges 56, 58 but may also differ from those. Therefore, one embodiment of the half pyramid shaped pyramidal tooth structure 20 will have a predetermined pitch and spacing depending on the requirements of the green structure. This green structure will then be bonded to a tool structure based on the above desired bonding methods and/or any other known bonding methods.

FIGS. 6 through 9 show an alternate embodiment of the pyramidal tooth structure 120 according to the present invention. Like numbers indicate like parts. The tooth structure 120 generally has a body 126 with a half a pyramid shape. The body 126 includes a rake face 148 generally having a 0° or neutral rake angle. However, it should be noted that any positive rake angle or even negative rake angle may be used. As shown in the figures the alternate embodiment tooth structure 120 terminates to a piercing point,101 which will be used to increase penetration and reduce friction of the tooth structure 120 in the material being ground. The tooth structure 120 also may include a clearance angle for the rake face 148 thus further increasing penetration and reducing friction of the tooth structure 120. From a side view the alternate embodiment tooth structure 120 generally has a triangular shape with a right angle therein. The alternate embodiment teeth structure also includes a clearance angle from the top of the point 101 of the cutting edge of the rake face 148, down to the bottom portion of the rear side angle 160 of the tooth structure 120. As described for the other embodiments shown the alternate embodiment tooth 120 may also be placed in rectangular sheets or any other shaped sheets having predetermined pitch and spacing for use on a grinding wheel or tool 22 in grinding non-metal materials. Any of the variously described methods of connecting the tooth structures 120 either individually or as sheets to tools can be used. When the tooth structures 120 are placed onto a grinding wheel 22 the rake frontal faces 148 will all be oriented towards the working direction of the wheel and will make the contact with the material being ground to a specific thickness.

Therefore, the new tooth structure 20 having a positive to neutral rake face 48 with the rake face 48 generally having a flatted surface being presented as the attack face on the grinding wheel to the material being ground will increase efficiency and reduce friction of the grinding wheel thus increasing tool longevity. Any of the known processes for preparing a bonded or abrasive grit structure which is adaptable for brazing to a tool substrate may be used for the novel tooth structure 20 described herein. Therefore, the structured pyramidal tooths 20 as described herein may be bonded by any known means such as individual tooths, as a sheet of teeth or in any other known manner to any known tool surface to create a grinding mechanism for use in grinding non-metal compositions.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention maybe practiced otherwise then as specifically described.

What is claimed is:

1. A tooth structure for use on a tool surface, said tooth structure including:

a pyramidal-like shaped body, said body having a face with a predetermined flat rake, said face having a negative rake angle;

a side edge defining in part said face of said body, said side edge having a predetermined clearance cutting angle; and said side edges of said face having a predetermined acute angle.

2. The tooth structure of claim 1 wherein said body terminates to a point at a top edge thereof.

3. The tooth structure of claim 1 wherein said body having a predetermined number of sides, said sides and said face are truncated to a straight edge at a top thereof, said face straight edge being flat and to run parallel to axis of rotation.

4. The tooth structure of claim 3 wherein said flat edge having a clearance angle with respect to a trailing edge of 10° or greater.

5. The tooth structure of claim 3 further including a plurality of tooth structures having a predetermined pitch and spacing arranged on a predetermined material, said material allows said plurality of tooth structures to be transferred from a mold to the tool surface.

6. The tooth structure of claim 5 wherein said plurality of tooth structures are brazable to said tool by infiltration of a brazing material therethrough and on to the tool, said brazing material bonds a plurality of grits to a predetermined molded shape on said tool.

7. The tooth structure of claim 1 further including a plurality of tooth structures having a predetermined pitch and spacing arranged on a predetermined material, said material allows said plurality of tooth structures to be transferred from a mold to the tool surface.

8. The tooth structure of claim 7 wherein said plurality of tooth structures are brazable to the tool surface by infiltration of a brazing material therethrough and on to the tool, said brazing material bonds a plurality of grits to a predetermined molded shape on said tool.

9. A tooth structure for use on a tool surface, said tooth structure including:

a pyramidal-like shared body, said body having a face with a predetermined flat rake, said body being a one half pyramidal like shape;

a side edge defining in part said face of said body, said side edge having a predetermined clearance cutting angle;

said side edge of said face having a predetermined acute angle.

10. The tooth structure of claim 9 wherein said face having a neutral or positive rake angle.

11. The tooth structure of claim 9 wherein said body terminates to a point at the top edge.

12. The tooth structure of claim 9 wherein said face having a negative rake angle.

13. A molded tooth structure for use on a tool surface for the cutting or grinding of non-metal materials, said molded tooth structure including:

a plurality of pyramidal shaped body portions, said body having a flat rake face, said rake face having a neutral or negative rake angle, each of said body portions having at least one grit particle therein, each of said body terminating to a point, said points being substantially equal in height, said grit particles being substantially surrounded by a setting material; and a binder dispersed throughout the structure for temporarily binding together said grit particles and said setting material.

14. The molded tooth structure of claim 13 further including side edges of said rake face having a predetermined clearance angle from said side edges.

15. The molded tooth structure of claim 14 wherein said rake face side edges having an included angle greater than or equal to 15°.

16. The molded tooth structure of claim 13 wherein said plurality of body portions having a predetermined pitch and spacing on a predetermined sized material.

17. The molded tooth structure of claim 13 wherein said binder being removable from said structure at a first predetermined temperature, said structure being brazable to the tool surface by the infiltration of a brazing material therethrough and onto the tool surface at a second predetermined temperature which is lower than the melting point of said setting material.

18. A molded tooth structure for use on a tool surface for the cutting or grinding of non-metal materials, said molded tooth structure including:

a plurality of pyramidal shaped body portions, said pyramidal shape body having a one half of a pyramidal shape, said body having a flat rake face, each of said body portions having at least one ant particle therein, said grit particles being substantially surrounded by a setting material; and a binder dispersed throughout the structure for temporarily binding together said grit particles and said setting material.

19. The molded tooth structure of claim 18 wherein said rake face having a neutral or positive rake angle.

20. A molded tooth structure for use on a tool surface for the cutting or grinding of non-metal materials, said molded tooth structure including:

a plurality of pyramidal-liked shaped body portions, said body having a flat rake face, each of said body portions having at least one grit particle therein, each of said body terminating to a point, said points being substantially equal in height, said grit particles being substantially surrounded by a setting material;

a binder dispersed throughout the structure for temporarily binding together said grit particles and said setting material; and side edges of said rake face having a predetermined clearance angle from said side edges, said point on said rake face being truncated to a flat edge at a top of said side edges, said flat edge having a clearance angle with respect to a trailing edge of 10° or greater.

* * * * *

UNITED STATES PATENT AND TRADEMARK OFFICE

CERTIFICATE OF CORRECTION

PATENT NO. : 6,821,196 B2
DATED : November 23, 2004
INVENTOR(S) : Lloyd R. Oliver It is certified that error appears in the above-identified patent and that said Letters Patent is hereby corrected as shown below:

Column 10,
Line 2, delete “ant” and insert -- grit -- before “particle” therein.

Signed and Sealed this

Twenty-ninth Day of November, 2005

JON W. DUDAS
*Director of the United States Patent and Trademark Office*